US005704618A

United States Patent [19]

Sfoggia

[11] Patent Number: 5,704,618

[45] Date of Patent: Jan. 6, 1998

[54] BRAKE STRUCTURE DEVICE, IN PARTICULAR FOR SKATES HAVING ALIGNED WHEELS

[76] Inventor: Narciso Sfoggia, Via della Consolata, 1, 31030 Biadene Di Montebelluna, Treviso, Italy

[21] Appl. No.: 652,385

[22] Filed: May 23, 1996

[30] Foreign Application Priority Data

May 24, 1995 [IT] Italy ..... TV95A0058

[51] Int. Cl.[6] ..... A63C 17/14

[52] U.S. Cl. ..... 280/11.2; 280/11.22

[58] Field of Search ..... 280/11.2, 11.21, 280/11.22

[56] References Cited

U.S. PATENT DOCUMENTS 3,790,187 2/1974 Radu et al. ..... 280/11.2
5,351,974 10/1994 Cech ..... 280/11.2
5,415,419 5/1995 Bourque ..... 280/11.2

FOREIGN PATENT DOCUMENTS 3036799 5/1982 Germany ..... 280/11.2

*Primary Examiner*—Brian L. Johnson
*Assistant Examiner*—Avraham Lerner
*Attorney, Agent, or Firm*—Wenderoth, Lind & Ponack

[57] ABSTRACT

A brake device structure, in particular for skates with aligned wheels of the type including a boot associated with a support frame for the wheels, as well as a lever positioned rearwardly of a first end of the frame. The lever is engageable with a part of the boot. In the braking structure the lever is located at a second end and is pivoted to the frame and at an intermediate zone thereof hinged to a rack which controls the structure for forcing at least one brake element against a lateral surface of one or more of the wheels. This solution results in an effective braking operation, while keeping the wheels of both skates firmly in contact with the ground, even if the skate is travelling at a high rate of speed.

22 Claims, 5 Drawing Sheets

BRAKE STRUCTURE DEVICE, IN PARTICULAR FOR SKATES HAVING ALIGNED WHEELS

BACKGROUND OF THE INVENTION

The present invention relates to a brake device structure, in particular for skates having aligned wheels of a type including a boot associated with a support frame for the wheels, as well as a lever situated posteriorly of a first end and associated with a part of the boot.

In known skates with aligned wheels, a drawback is the problem of obtaining optimum braking while keeping the skates in racing trim, with all wheels in contact with the ground.

To combat this drawback, the prior art teaches skates wherein a lever is located posterior to the boot and interacts with a device which is pivoted to the wheel support frame and connected to a pad which, at a backwards-directed oscillation of the boot, interacts with the ground.

This and other solutions, which provide for example a rubber pad directly associated with the front or back end of the wheel support frame, do not provide optimum braking especially in situations where the skate is travelling at a considerable speed, as it is necessary to raise the wheels in order to bring the pad into contact with the ground, thus altering the trim of the skate.

Further, in known-type solutions, braking is not always gradual, leading to imperfect control of the skate on the part of the user.

SUMMARY OF THE INVENTION

The main object of the present invention is to solve the above-described technical problems and to eliminate the drawbacks of the prior art by providing a brake device system for skates having aligned wheels which, following a simple activation by the user, provides excellent braking even when the skate is travelling at a considerable speed.

A further important object of the invention is to provide a brake device which gives a gradual braking effect.

A still further important object is to provide a brake device which adds to the previous advantageous characteristics the fact that the braking operation avoids abrupt changes in speed which might result in a loss of balance.

A still further object is to provide a braking device which, once activated, allows the skates to stay in race trim, that is, the wheels are constantly in contact with the ground.

A still further object is to provide a brake device which is sure and reliable in use, while affording contained production costs.

The above-mentioned objectives, and others which will better emerge during the course of the following description, are realized by the brake structure device, in particular for skates having aligned wheels, including a boot associated with a support frame for the wheels and a posterior lever associated with a first end of the support frame and a part of the boot. The brake structure device is characterized in that the lever is at a second end thereof pivoted to the frame and, at an intermediate zone thereof, is hinged to a rack. The rack is slidably associated with the frame. The rack controlling means for forcing at least one brake device on to a lateral surface of one or more wheels of the skate.

Further characteristics and advantages of the present invention will be apparent from the following detailed description of embodiments of the present invention, which are illustrated in the form of a non-limiting example in the accompanying drawings, in which:

DETAILED DESCRIPTION OF THE INVENTION

Figure 1:
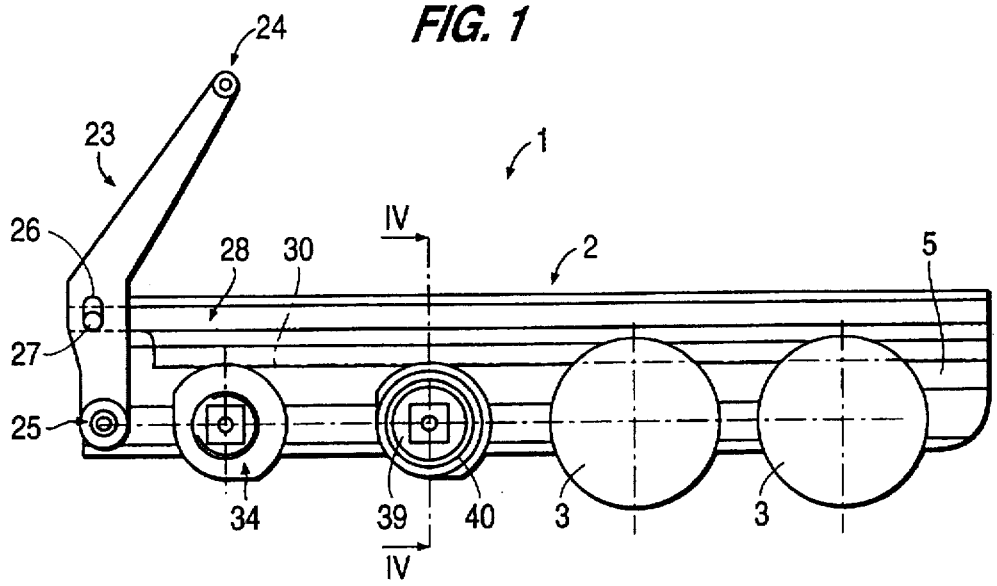
FIG. 1 is a lateral view of a frame bearing a brake device structure in an inactive position.
Figure 2:
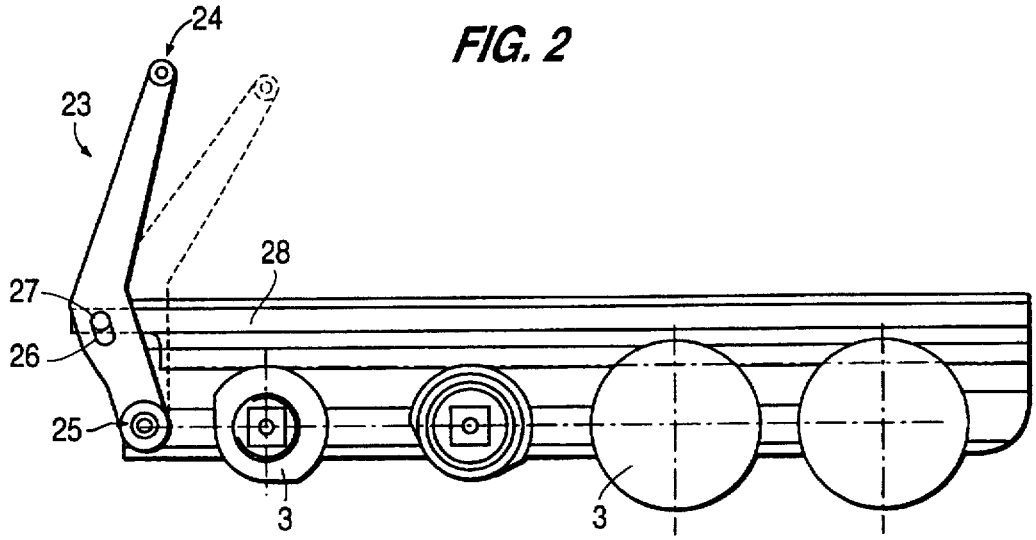
FIG. 2 is a lateral view of the frame bearing the brake device in an active position.
Figure 3:
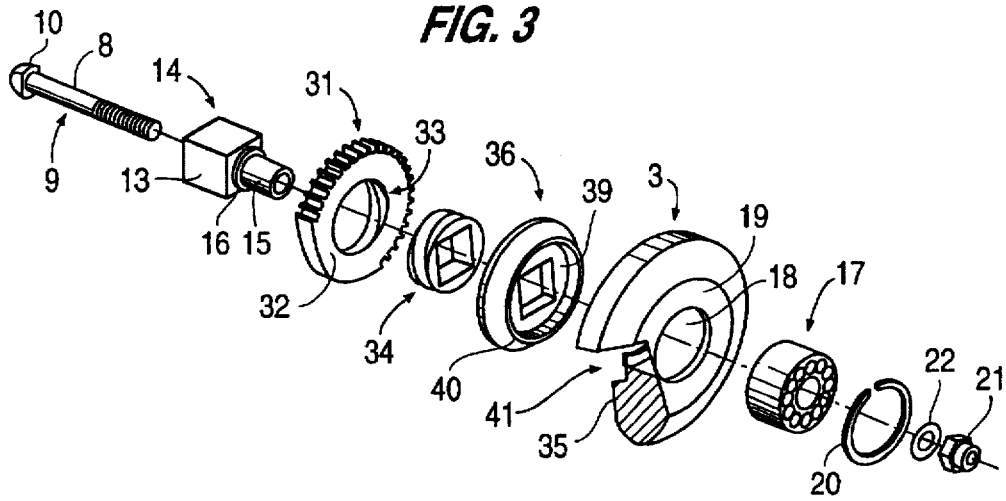
FIG. 3 is an exploded view of some components of the brake device structure.
Figure 4:
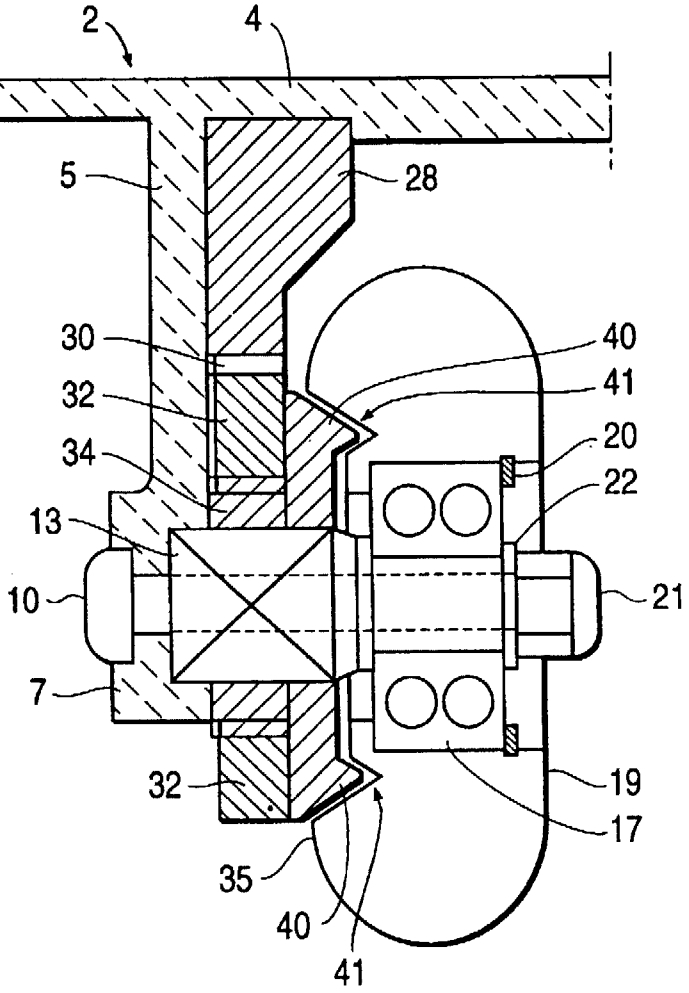
FIG. 4 is a view taken along section IV—IV of FIG. 1.
Figure 5:
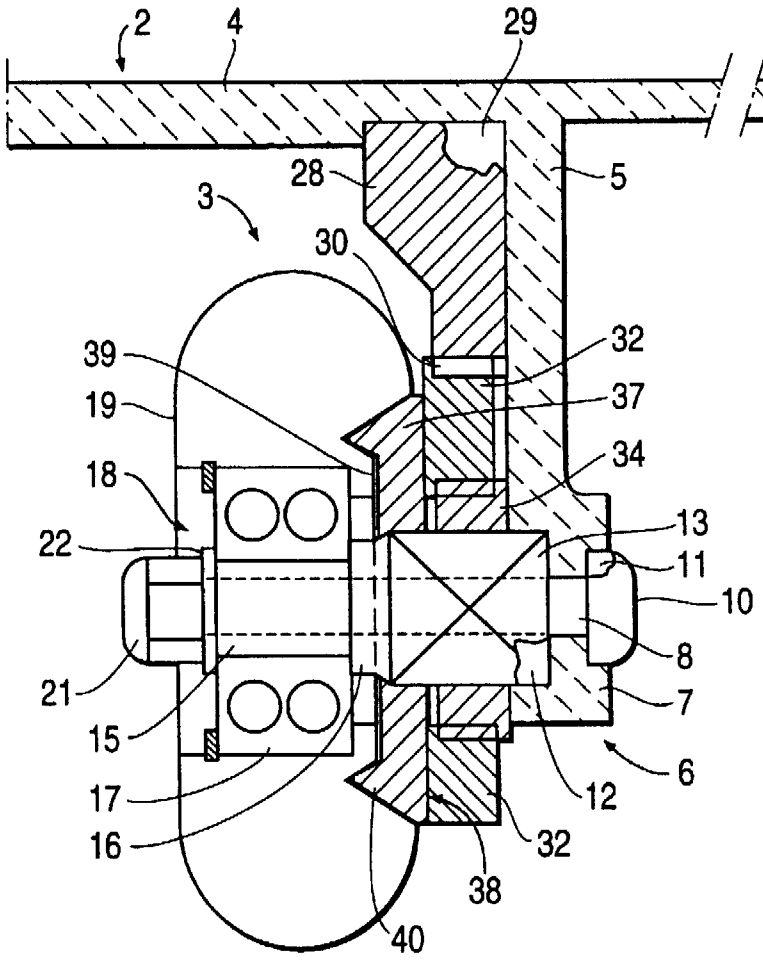
FIG. 5, which is similar to FIG. 4, shows a brake device structure of an "opposite skate" and the brake device structure is shown in an active position.
Figure 6:
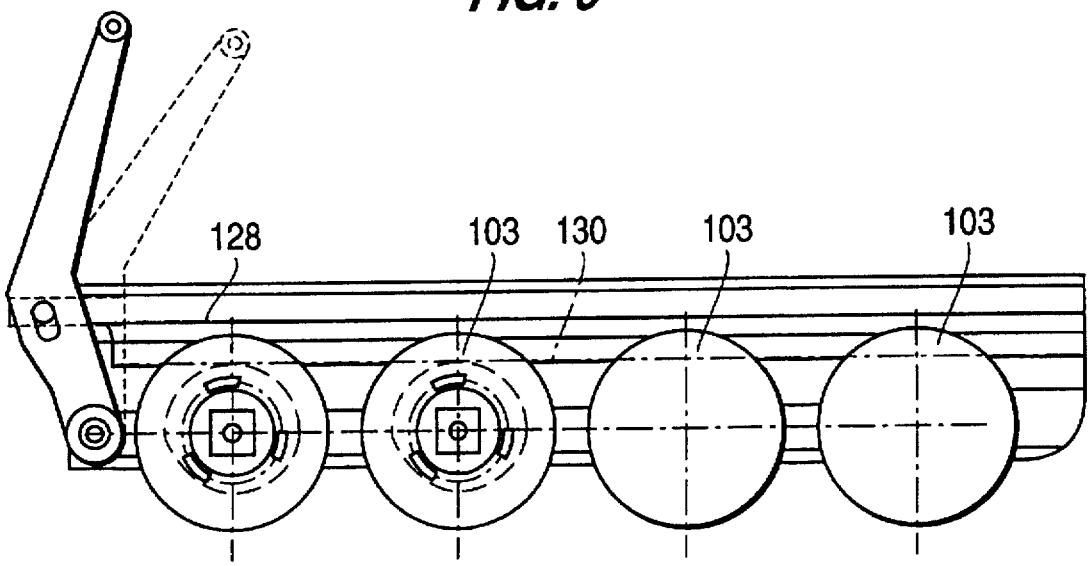
FIG. 6, which is similar to FIG. 2, shows a further embodiment of the present invention.
Figure 7:
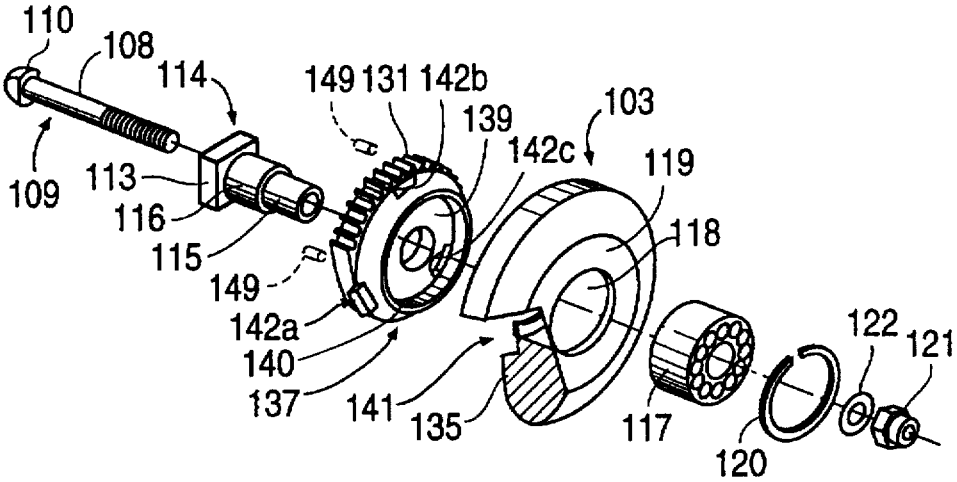
FIG. 7, which is similar to FIG. 3, is an exploded view of the components of FIG. 6.
Figure 8:
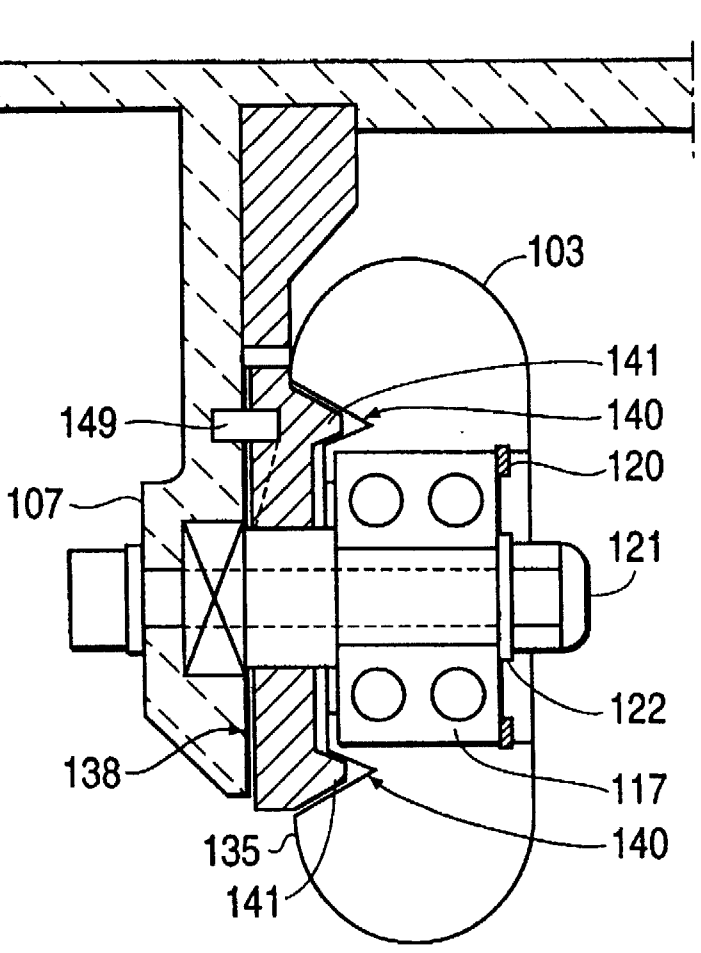
FIGS. 8 and 9 show, in views similar to FIGS. 4 and 5, the embodiment of FIG. 6.
Figure 9:
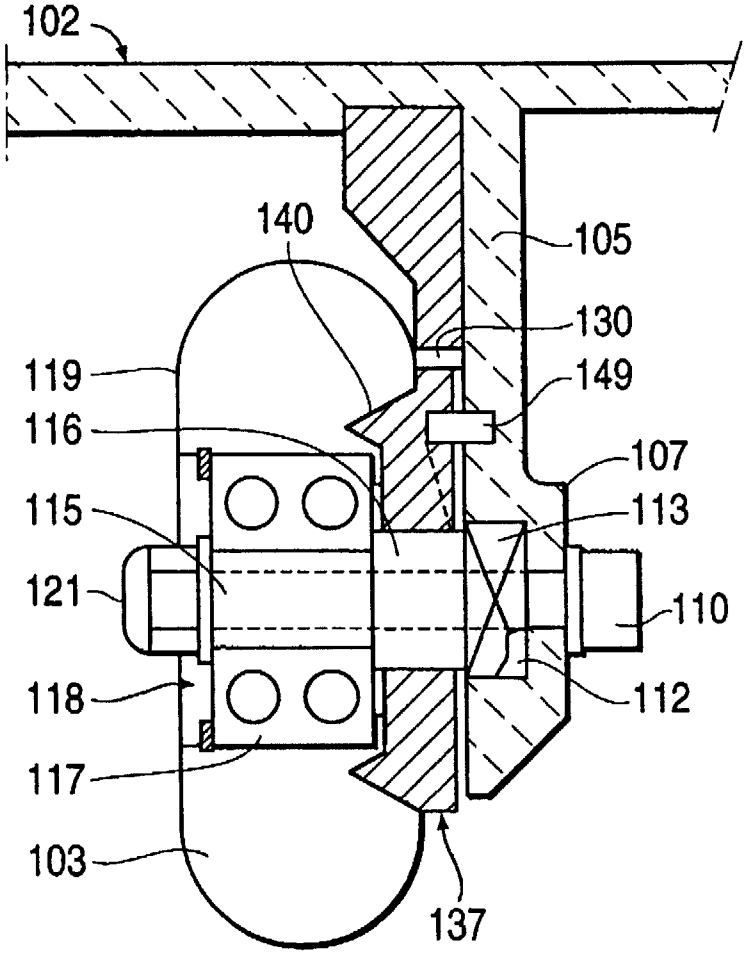

With reference to the above-mentioned figures of the drawings, 1 denotes a skate including a boot which is associated with a support frame 2 for a plurality of wheels 3 which are linearly aligned.

The support frame 2 includes a flat base 4 for the boot. A single wing 5 projects inferiorly and eccentrically from the flat base and defines, at a bottom end 6 thereof, a broadened or wider part 7 in which a first through hole is provided. The hole functions as a seating surface for a first shaft portion or stem 8 of a threaded bolt 9 which has a first head 10 keyable into a first seating area 11 which is formed in the broadened part 7.

A second seating 12 is formed in an opposite side of the broadened part 7. The second seating area 12 receives an end of a square-plan head 13 of a pivot 14. The pivot 14 is axially bored to permit passage therethrough of the first shaft portion 8 of the threaded bolt 9. The pivot 14 includes a stem 15 which is cylindrically shaped and has an external diameter which is smaller than the diagonal of the square head 13 and which is connected thereto by a ring 16 of an intermediate size.

A bearing 17 is coaxially positioned on the stem 15. The bearing 17 is housed in a complementarily-shaped seating area 18 formed in a first lateral surface 19 of a wheel 3.

The bearing 17 is blocked interiorly in the seating area 18 by means of a grommet 20. The wheel 3 is secured by the threaded bolt 9 by means of a self-locking nut 21 and a washer 22.

The brake device includes a lever 23 having a first end 24 which is associated with a part of the boot secured on support frame 2, and a second end 25 pivotally connected to the wing 5 of the frame 2. The lever 23 defines, at an intermediate zone between the first end 24 and the second end 25, a slot 26 for receiving a pivot 27 which is connected to a rack 28 which is slidably associated with the frame 2. The rack 28 is preferably slidable in a predisposed seating area 19, formed inferiorly in the base 4 of the support frame 2, and is in contact with a wall of the wing 5, and has a cogging or gear teeth 30 in the direction of the first shaft portion stem 8 of the threaded bolt 9.

A movement-fluidizing element, made for example of the material known as TEFLON, can be advantageously interpositioned at the seating area 29, and connected to the seating area 29 by means of the ring 16 of intermediate dimensions.

The cogging 30 of the rack 28 interacts with a cogging or teeth 31 of a gear wheel 32 axially exhibiting a seating 33 which is threaded to receive and couple with a threaded ring nut 34. The threaded ring nut 34 is coaxially keyed on the square head 13 of pivot 14.

The interaction among the above identified elements will now be described. Once a user imposes a backwards movement, for example by displacing the ankle of the boot, the lever 23 is displaced backwards due to the pivoting about the second end 25 of the lever relative to the support frame 2. In turn, the rack 28 slides and causes wheel 32 to rotate. The gear wheel 32 will then unscrew with respect to the ring nut 34 (keyed on the second head 13 of the pivot 14). The unscrewing direction of the gear wheel 32 will be in a direction towards the second lateral surface 35 (which faces the gear wheel 32) of the wheel 3.

The gear wheel 32 and the ring nut 34 constitute means for forcing at least one brake element, denoted in its entirety by 36, to interact on the second lateral surface 35 of the wheel 3 and perform a braking operation.

The brake element 36 is constituted by a disc 37 keyed at the square head of the pivot 14, and exhibits a third surface 38 breasting the gear wheel 32 and a fourth surface 39 facing the second lateral surface 35 of the wheel 3.

A ring 40 projects from the perimeter of the fourth surface 39, which ring 40 exhibits a substantially triangular transverse section. The ring 40 is received in a complementarily-shaped seating 41 formed in the second lateral surface 35 of the wheel 3.

During a braking operation, the displacement of the rack 28 is followed by an unscrewing of the car wheel 32 which pushes the disc 37 and therefore the ring 40 into the seating 41, so that braking is achieved.

When the user vertically repositions the ankle of the boot, the displacement imposed on the rack 28 leads to the rescrewing of the gear wheel 32 on the ring nut 34, removing the friction force applied on wheel 3 by disc 37.

A deformable elastic element may advantageously be provided, such as a spring, coaxially arranged on the ring 16 of the pivot 14 and therefore positioned between the bearing 17 and surface 39 of disc 37.

Thus, the present invention achieves its set aims and objectives by providing a brake device structure which allows a user to easily and gradually control a braking operation.

Obviously, the present invention is susceptible to numerous modifications and variations, all entering within the scope of the inventive concept as described herein.

FIGS. 6 to 9 illustrate a second embodiment of the present invention in which the broadened part 107 includes a first hole, functioning as a seating for a first stem or shaft 108 of a threaded bolt 109 exhibiting a head 110 engaging the broadened part 107.

A seating area 112 is provided in an opposite side of the broadened part 107. The seating area 112 receives an end of a square head 113 of a pivot 114. The pivot 114 is axially bored to permit passage therethrough of the shaft 108 of screw 109.

The pivot 114 includes a shaft portion or stem 115, cylindrically shaped and having an external diameter which is smaller than the diagonal of the head 113 and which is connected thereto by a ring 116 of an intermediate size.

A bearing 117 is positionable coaxially on the shaft portion 115. The bearing 117 can be housed for a part of a breadth thereof in a complementarily-shaped seating area 118 formed in a first lateral surface 119 of the wheel 103.

The bearing 117 is blocked internally in the seating area 118 by means of a grommet 120, while the wheel 103 is associated with the screw 109 by means of a self-locking nut 121 and a washer 122.

A rack 128 is also present in the second embodiment, and exhibits cogging or teeth 130 which interact with a cogging or teeth 131 provided on a brake element constituted by a disc 137 mounted slidably and coaxially to the ring 116, and having a surface 138 breasting the first head 113 and a surface 138 facing the second lateral surface 135 of the wheel 103.

A second ring 140 projects from the perimeter of the surface 139. The second ring 140 exhibits an essentially triangular cross-section and is received in a complementarily-shaped seating area 141 formed in the second lateral surface 135 of the wheel 103.

From the wheel-facing surface of the wing 105 of frame 102 project predisposed pins 141, which in this embodiment are three in number, arranged staggered on a same circumference by 120 degrees.

Each of the pins 141 has an end which is housed in one of three predisposed identical seating areas **142*a*, 142*b* and 142*c* formed on the facing third surface 138 of the disc 137** and staggered by 120 degrees.

The seating areas **142*a*, 142*b* and 142*c* extend along to an arc of circumference with progressively varying depths for each, from a minimum to a maximum, and defines an inclined plane with which the pins 141** interact.

During a braking operation, when the rack 128 is displaced leading to a rotation of the disc 137, the conformation of the seating areas imposes, thanks to the interaction thereof with the pins, a displacement of the disc itself axially along the screw 109, which brings the ring 140 into the seating area 141 and activates the braking operation.

When the user vertically repositions the boot ankle, the displacement imposed on the rack causes the disc 137 to rotate in an opposite direction and uncouples the ring 140 from the seating area 141.

A deformable elastic element may advantageously be provided, such as a spring, coaxially arranged relative to the ring 116 of the pivot 114, and therefore interpositioned between the bearing 117 and surface 139 of the disc 137.

Thus, this embodiment achieves the set aims and objectives of the present invention.

Figure 10:
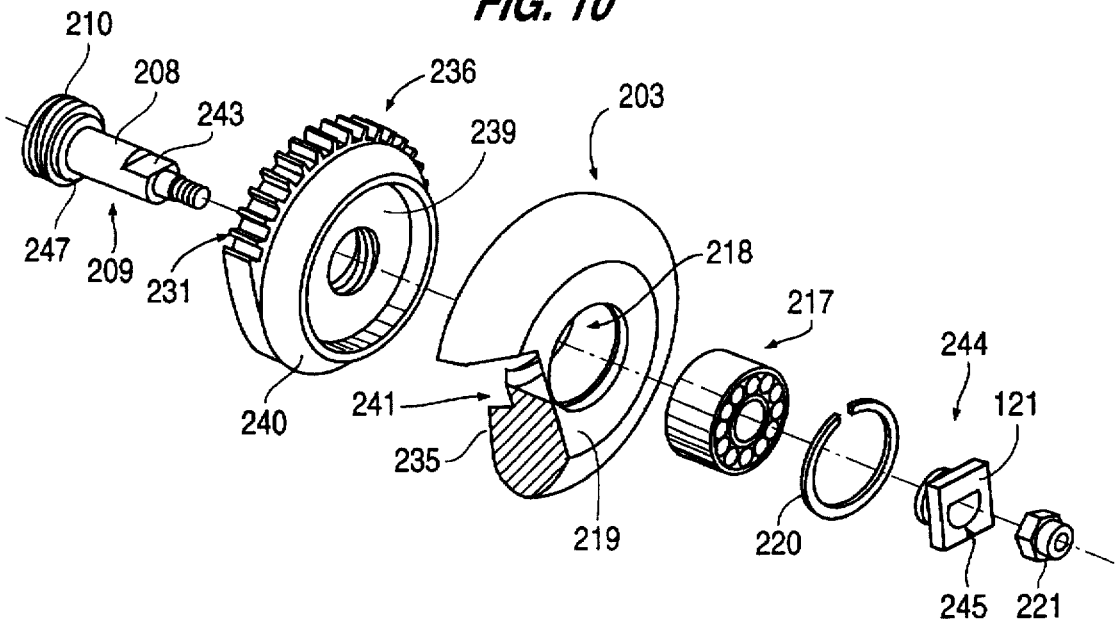
FIG. 10 shows, in a view similar to FIG. 3, an exploded view of a further embodiment.
Figure 12:
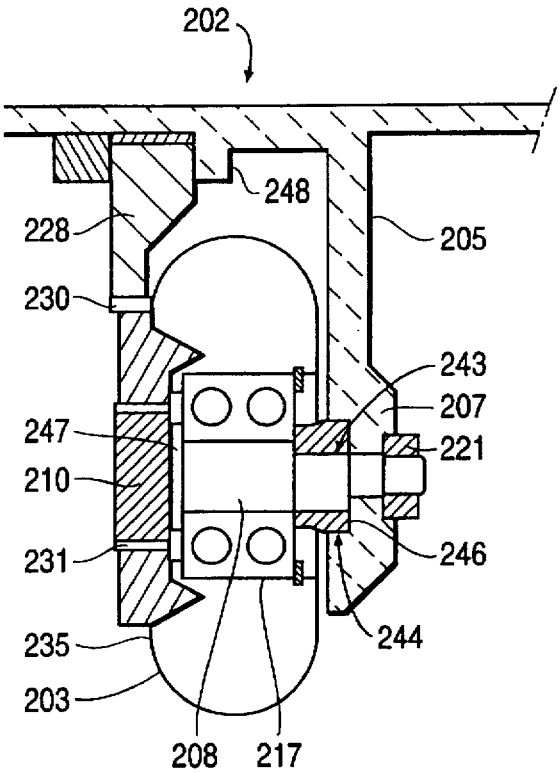
FIGS. 11 and 12 show, in views similar to FIGS. 4 and 5, the embodiment of FIG. 10.
Figure 11:
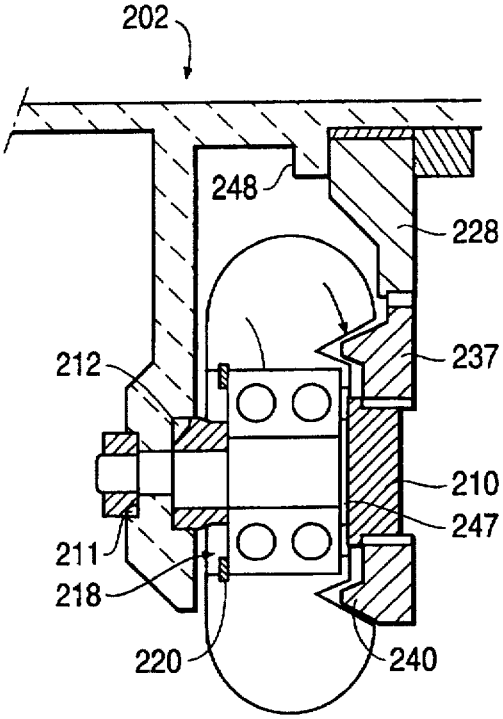

FIGS. 10 to 12 illustrate a third embodiment of the present invention, in which the frame 202 includes a wing 205 with a broadened part 207 having a first hole which functions as a seating for a stem or shaft 208 or a screw 209 exhibiting a head 210 and a ring 247. The lateral surface of the head 210 is threaded.

In proximity of the free end thereof the stem 208 has an axially-made cut 243 for keying-on of a spacer 244 having a seating surface 245 and a square head 246.

The head 246 is keyed into a complementarily-shaped second seating area 212 formed in the lateral surface of the wing 205 facing the wheel 203.

The stem 208 is threaded at a free end thereof for interconnecting with a self-locking nut 221 partially keyable in a seating area 211 formed in the lateral surface of the wing 205 facing in an opposite direction to the wheel 203.

A bearing 217 is positionable coaxially on the first stem 208. The bearing 217 is housable for a part of a breadth thereof in a complementarily-shaped seating area 218 formed axially to an at a first lateral surface 219 of a wheel 203.

Once more, the bearing 217 is blocked internally in the third seating 218 by means of a grommet 220. The wheel 203 is attached to the wing 205 by fastening the screw 209, thus the bearing 217 is blocked between the spacer 244 and the ring 247.

Once more, the brake device includes a rack 228 slidably mounted inferiorly of the frame 202, but in a plane which is parallel to the wing 205 and adjacent to the second lateral surface 235 of the wheel 203.

The rack 228, slidable in a guide 248 provided on the base 4 of the frame. The rack 228 includes a first cogging or teeth 230 interacting with a cogging or teeth 231 on a brake element, denoted in its entirety by 236. The brake element is constituted by a disc 237 which is axially bored and exhibits a threaded part for screwing to the head 210 of the screw 209.

The disc 237 has a surface 239 facing the second lateral surface 235 of the wheel 203. A ring 240 projects from the perimeter of the surface 239. The ring 240 exhibits a substantially triangular cross section and is housable in a complementarily-shaped seating area 241 formed in the second lateral surface 235 of the wheel 203.

During a braking operation, when the rack 228 is displaced, rotation is imposed on the disc 237 which (being mounted on head 210) therefore translates in the direction of the wheel 203 such as to bring the ring 240 into the seating area 241 to achieve braking.

When the user vertically repositions the ankle of the boot, the displacement imposed on the rack leads to an opposite rotation of the disc 237 which causes movement of the ring 240 away from wheel 203.

Thus, this embodiment also achieves the aims and objections of the present invention.

Obviously, the materials and the dimensions of the particular components of the illustrated structure can be chosen according to specific needs.

I claim:

1. A brake assembly for a skate having aligned wheels, said brake assembly comprising:

a flat boot support frame;

a wing structure, connected to and extending downwardly from said support frame, said wing structure having an upper edge portion connected to said support frame, a lower edge portion which is thicker than said upper edge portion, a first end, and a second end;

a rigid lever located at said rear end of said support frame and being pivotally connected to said first end of said wing structure;

a rack slidably engaging said support frame, said rack being connected to said rigid lever such that pivotal movement of said lever effects longitudinal movement of said rack; and at least one braking element connected to said lower edge portion of said wing structure, said at least one braking element engaging said rack such that longitudinal movement of said rack effects movement of said at least one braking element toward a lateral surface of a wheel.

2. The brake assembly as claimed in claim 1, further comprising:

a through hole formed in said lower edge portion of said wing structure;

a threaded bolt extending though said through hole, said threaded bolt having a head which is received in a first seating area formed in said lower edge portion of said wing structure; and a square pivot head engaged in a second seating area formed in said lower edge portion of said wing structure opposite said first seating area, said square pivot head having a through hole through which said threaded bolt extends.

3. The brake assembly as claimed in claim 2, further comprising:

a hollow cylindrical portion having an outer diameter which is smaller than a diagonal of said square pivot head, wherein said threaded bolt extends through said hollow cylindrical portion;

a ring connecting said hollow cylindrical portion to said square pivot head; and a bearing positioned coaxially on said hollow cylindrical portion, said bearing being receivable in a seating area formed in a lateral surface of a wheel.

4. The brake assembly as claimed in claim 3, further comprising an elastically deformable element positioned on said ring between said bearing and said at least one braking element.

5. The brake assembly as claimed in claim 3, further comprising a self-locking nut engaging said threaded bolt for connecting a wheel to said brake assembly.

6. The brake assembly as claimed in claim 1, wherein said lever includes a slot located at an intermediate portion of said lever, said slot receiving a projection provided on said rack.

7. The brake assembly as claimed in claim 1, wherein said support frame includes a longitudinal recess configured to slidably receive said rack, and said rack slidably contacts a wall surface of said wing structure.

8. The brake assembly as claimed in claim 7, wherein a material is provided in said longitudinal recess to facilitate sliding movement of said rack.

9. The brake assembly as claimed in claim 1, further comprising:

an exteriorly threaded ring nut provided on said square pivot head; and a gear wheel having a threaded interior opening which is threadedly engaged with said exteriorly threaded ring nut, and gear teeth formed in an outer peripheral surface of said gear wheel, wherein said rack includes teeth which engage said gear teeth of said gear wheel such that longitudinal movement of said rack rotates said gear wheel which moves along a longitudinal axis of said threaded bolt toward and away from a lateral surface of a wheel.

10. The brake assembly as claimed in claim 1, wherein said brake element is a disc having an annular projection which is engageable in a complimentary recess formed in the wheel, wherein said annular projection has a triangular shaped cross section.

11. The brake assembly as claimed in claim 2, further comprising a plurality of pins projecting from said wing structure toward said braking element.

12. The brake assembly as claimed in claim 11, wherein:

said brake element is a disc having an annular projection which is engageable in a complimentary recess formed in the wheel;

said annular projection has a triangular shaped cross section; and said plurality of pins comprises three pins located in positions which correspond to said annular projection and are circumferentially spaced by 120 degrees.

13. The brake assembly as claimed in claim 12, wherein said brake element includes three seating areas located so as to receive said three pins therein, respectively.

14. The brake assembly as claimed in claim 13, wherein each said seating area is formed as a recess having a varying depth so as to define an inclined plane such that, upon rotation of said gear wheel in one direction, said pins push said brake element along a longitudinal axis of said threaded bolt.

15. The brake assembly as claimed in claim 1, further comprising:

a through hole formed in said lower edge portion of said wing structure;

a threaded bolt having a shaft portion which extends though said through hole and a head having a threaded lateral surface.

16. The brake assembly as claimed in claim 15, further comprising a square spacer engaged in a first seating area formed in said lower edge portion of said wing structure, said square spacer having a through hole receiving said threaded bolt, wherein a surface of said shaft portion is formed with a flattened portion corresponding to said spacer through hole.

17. The brake assembly as claimed in claim 16, further comprising a self-locking nut engaging an end of said threaded bolt, wherein said self-locking nut is received in a second seating area formed in said lower edge portion of said wing structure opposite to said first seating area.

18. The brake assembly as claimed in claim 17, further comprising a bearing positioned on said threaded bolt, said bearing being locked between said spacer and bolt head.

19. The brake assembly as claimed in claim 18, wherein said at least one braking element comprises a disc having a threaded through bore for receiving said threaded bolt head.

20. The brake assembly as claimed in claim 19 wherein said disc comprises a gear wheel having gear teeth formed in an outer peripheral surface of said gear wheel, said teeth engaging said rack such that movement of said rack rotates said gear wheel which results in lateral movement of said gear wheel toward a wheel.

21. The brake assembly as claimed in claim 19, wherein said disc includes an annular projection adapted to engage a wheel surface.

22. The brake assembly as claimed in claim 21, wherein said disc has a threaded through bore for receiving said threaded bolt head.

* * * * *